US009345350B2

(12) United States Patent
Feldmann et al.

(10) Patent No.: US 9,345,350 B2
(45) Date of Patent: May 24, 2016

(54) DRINKING CUP MADE OF FOLDABLE FLAT MATERIAL

(75) Inventors: André Feldmann, Hamburg (DE); Arne Schultchen, Hamburg (DE)

(73) Assignee: Feldmann + Schultchen Design Studios GmbH, Hamburg (DE)

( * ) Notice: Subject to any disclaimer, the term of this patent is extended or adjusted under 35 U.S.C. 154(b) by 0 days.

(21) Appl. No.: 14/344,743

(22) PCT Filed: Sep. 5, 2012

(86) PCT No.: PCT/EP2012/003721

§ 371 (c)(1),
(2), (4) Date: Jun. 6, 2014

(87) PCT Pub. No.: WO2013/037462

PCT Pub. Date: Mar. 21, 2013

(65) Prior Publication Data

US 2014/0339242 A1 Nov. 20, 2014

(30) Foreign Application Priority Data

Sep. 15, 2011 (DE) ..... 10 2011 113 347 U

(51) Int. Cl.
*A47G 19/22* (2006.01)
*B65D 3/08* (2006.01)

(52) U.S. Cl.
CPC ..... *A47G 19/2205* (2013.01); *B65D 3/08* (2013.01)

(58) Field of Classification Search
CPC ..... A47J 19/2205; B65D 5/02; B65D 5/46
USPC ..... 220/666; 229/404
See application file for complete search history.

(56) References Cited

U.S. PATENT DOCUMENTS

| | | | | |
|---|---|---|---|---|
| 1,262,289 | A | | 4/1918 | Weber |
| 2,134,321 | A | | 10/1938 | Amberg |
| 2,884,181 | A | * | 4/1959 | McCormick ..... 206/527 |
| 3,743,131 | A | | 7/1973 | Croyle et al. |
| 4,331,255 | A | | 5/1982 | Fournier |
| 4,846,396 | A | * | 7/1989 | Palazzolo ..... 229/117.12 |
| 5,000,375 | A | | 3/1991 | Färber et al. |
| D353,337 | S | * | 12/1994 | Halasz et al. ..... D9/774 |
| 5,938,107 | A | * | 8/1999 | Anchor et al. ..... 229/109 |
| D510,679 | S | * | 10/2005 | Smith et al. ..... D7/396.2 |
| 2004/0011862 | A1 | | 1/2004 | Sarson et al. |

(Continued)

FOREIGN PATENT DOCUMENTS

| | | |
|---|---|---|
| DE | 2305538 | 8/1973 |
| DE | 20319157 | 3/2004 |

(Continued)

OTHER PUBLICATIONS

International Preliminary Report on Patentability for PCT/EP2012/003721, dated Mar. 18, 2014.

(Continued)

*Primary Examiner* — Anthony Stashick
*Assistant Examiner* — Raven Collins
(74) *Attorney, Agent, or Firm* — White & Case LLP

(57) ABSTRACT

The invention relates to a cup made of foldable flat material with at least one desired fold line (22) along which a convex cup wall (24) can be pushed in to give a concave, dimensionally-stable form.

7 Claims, 6 Drawing Sheets

(56) References Cited

U.S. PATENT DOCUMENTS

Figures 1A, 1B:
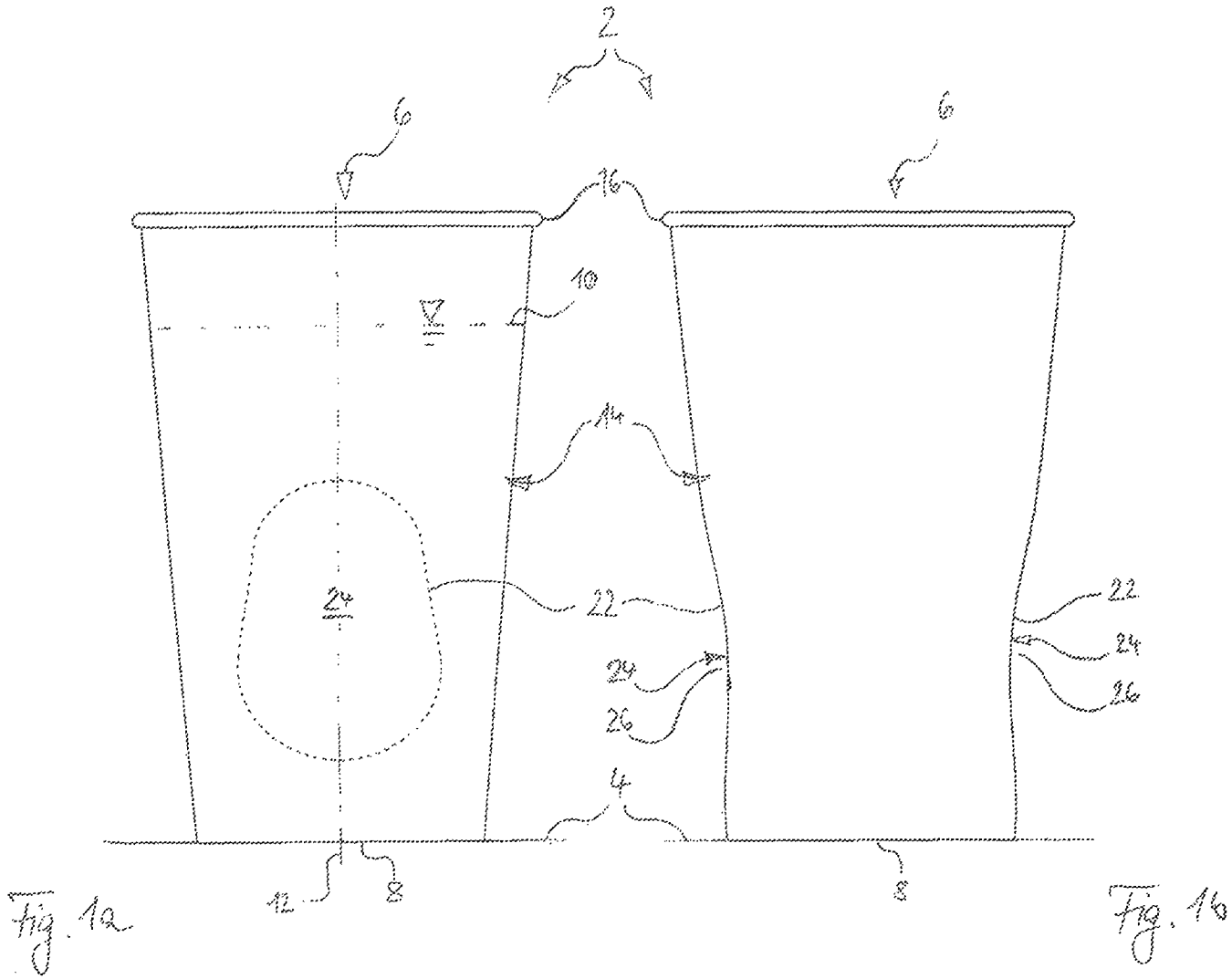

| | | | |
|---|---|---|---|
| 2005/0230404 | A1 | 10/2005 | Dark |
| 2010/0252555 | A1 | 10/2010 | Syed |
| 2011/0068101 | A1 | 3/2011 | Yablonowski |

FOREIGN PATENT DOCUMENTS

| | | |
|---|---|---|
| DE | 60206135 | 1/2006 |
| DE | 60107965 | 3/2006 |
| DE | 202011004316 | 6/2011 |
| EP | 0068334 | 1/1983 |
| EP | 0131862 | 1/1985 |
| EP | 1354804 | 10/2003 |
| EP | 2266894 | 12/2010 |
| FR | 2096399 | 2/1972 |
| GB | 1381975 | 1/1975 |
| JP | 2001063719 | 3/2001 |
| JP | 2001139016 | 5/2001 |
| WO | WO-01/94215 | 12/2001 |
| WO | WO-2005/077768 | 8/2005 |
| WO | WO-2005/097606 | 10/2005 |
| WO | WO-2007/110897 | 10/2007 |
| WO | WO-2013/034289 | 3/2013 |
| WO | WO-2013/034290 | 3/2013 |
| WO | WO-2013/037462 | 3/2013 |

OTHER PUBLICATIONS

International Search Report and Written Opinion for PCT/EP2012/003722, mailed Mar. 12, 2014.

International Search Report and Written Opinion for PCT/EP2012/003721, mailed Jan. 2, 2013.

International Search Report and Written Opinion for PCT/EP2012/003722, mailed Jan. 2, 2013.

* cited by examiner

DRINKING CUP MADE OF FOLDABLE FLAT MATERIAL

The invention relates to a drinking cup.

There are drinking cups for hot and cold beverages, disposable and for multiple use, and are correspondingly made of different materials such as ceramic, glass, metal, plastic, cardboard with a watertight or water-repellent coating or impregnated, and combinations thereof. Cups within the broadest sense according to the invention are understood to be containers that can be properly gripped with one hand and lifted in accordance with their size and weight, and that have an opening (drinking opening) with an edge design to enable a human to drink drip-free, and that have a footprint or a support device that allows the cup to be set down on a horizontal surface so that the liquid remains in the cup. In particular, cups within a narrower sense according to the invention are understood to be containers that are rotationally symmetrical about a vertical axis, at least in the area of the opening (properly set down on a horizontal plane), and, at least with its inner wall, that narrow axially downward from the edge, at least in the area of the opening.

Such cups, especially those to be discarded, also have a cover, as is known, that can cover the drinking opening to prevent the drinking liquid within from spilling. Such covers and cups, including those according to the invention, are especially provided in catering establishments where beverages are (also) dispensed for consumption along the way. The known covers are preferably made of plastic such as recyclable polypropylene and normally have a snap-on structure that is suitable for snapping on and gripping an edge area of the drinking opening of a cup in a form-fit manner. In particular, disposable cups, especially made of plastic or cardboard, normally have a drinking edge that surrounds the drinking opening and has a cross-section folded over in a circular manner to the outside. This is gripped by the known snap-on structures of known generic covers in a snap-on, form-fit manner. It is known that the diameter of the snap-on structure close to the cup edge along with the width of the snap-on opening are adapted to the cup geometry for which they are provided, and are especially standardized as well.

With known cups, especially those for discarding, e.g. made of plastic or with a watertight or water-repellent coating or impregnated cardboard, at least sections of the cup walls consist of foldable, flat material. According to the invention, foldable only means that the flat material (immediately upon being subject to a load, or possibly only after a certain degree of limited deformation) is not only elastically but also plastically deformed, wherein this limited degree of deformation can occur by manual force on the piece of flat material of the size installed in the respective cup.

The walls of known cups made of foldable material are normally optimized such that the flat material is designed to be as thin as possible in order to save material (and also to discard as little thereof as possible). As has been disadvantageously demonstrated, the material is, however, saved at the cost of the cups being easily compressed even when gripped just a bit too strongly. This deformation is then associated with the risk that, for example, the bottom footprint of the cup is also deformed and makes the cup wobbly. An additional risk is that the wall is not only plastically deformed but also becomes leaky along the kink lines or places that can arise upon being pushed in, for example because they crack in a brittle manner.

The object of the invention is to create a drinking cup made of a foldable flat material that can be handled without being destroyed.

This object is achieved by a drinking cup having the features of claim 1. Preferred developments are stated in the dependent claims.

According to the invention, a cup made of foldable flat material has at least one desired fold line that can be pushed in with a concave, stable shape along a convex wall of the cup.

According to the invention, "convex wall" means a wall that is curved in a convex manner to the outside of the cup, and is curved at least regionally and at least, and preferably, once (about at least one axis of curvature). The flat material is for example cardboard, preferably with a watertight or water-repellent coating, especially on the inside of the cup, or plastic such as polypropylene.

The desired fold line in the cup wall is preferably a line of a thinner wall thickness and/or a stamped and/or prefolded line. If a user for example pushes a (convex) cup wall in close proximity to the desired fold line with his thumb and/or index finger, it is pushed in as in the prior art, but does not deform in a nondirected manner as in the prior art, but is rather pushed in along the desired fold line in a concave stable shape. According to the invention, a stable shape only means that the flat material immediately upon being subject to a load, or possibly only after a certain degree of limited deformation, is not only elastically but also plastically deformed along the desired fold line, wherein this limited degree of deformation in the cup according to the invention can occur by manual force. The area pushed in according to the invention can serve as a structural reinforcement to the cup wall.

Preferably, the desired fold line in the cup wall runs in a closed ring, particularly preferably symmetrically mirrored across a plane that is oriented vertically when the cup stands on a horizontal plane according to the invention. An impressible area according to the invention delimited by the annular desired fold line therefore results and is annularly surrounded by the desired fold line and, pushed in convexly, forms a recess that can in turn serve as a structural reinforcement of the cup wall that particularly preferably can be used as a gripping recess. To aesthetically design the cup, the desired fold line according to the invention can also advantageously serve to provide an additional design element from the desired fold lines running in any type of curved and/or kinked according to the invention in the simple cup shapes which are widespread as is well known, especially of disposable cups with a frusticonical shape, i.e. exclusively convex shape in their lateral surface, the additional design element also providing concave design elements in the lateral surface after being pushed and even permitting a waisted cup shape to be created.

In particular when preferably a plurality of desired fold lines are equivalent in a cup according to the invention and are particularly preferably evenly distributed over a perimeter of the cup, and/or are arranged at the same height in the cup, a regular peripheral pattern of concave reinforcing impressions can result. In particular, when said reinforcing impressions lie in single and multiple pairs opposite each other over the perimeter (distributed over the perimeter by) 180°), a cup shape with a particularly strongly waisted appearance can arise.

Figures 2A, 2B:
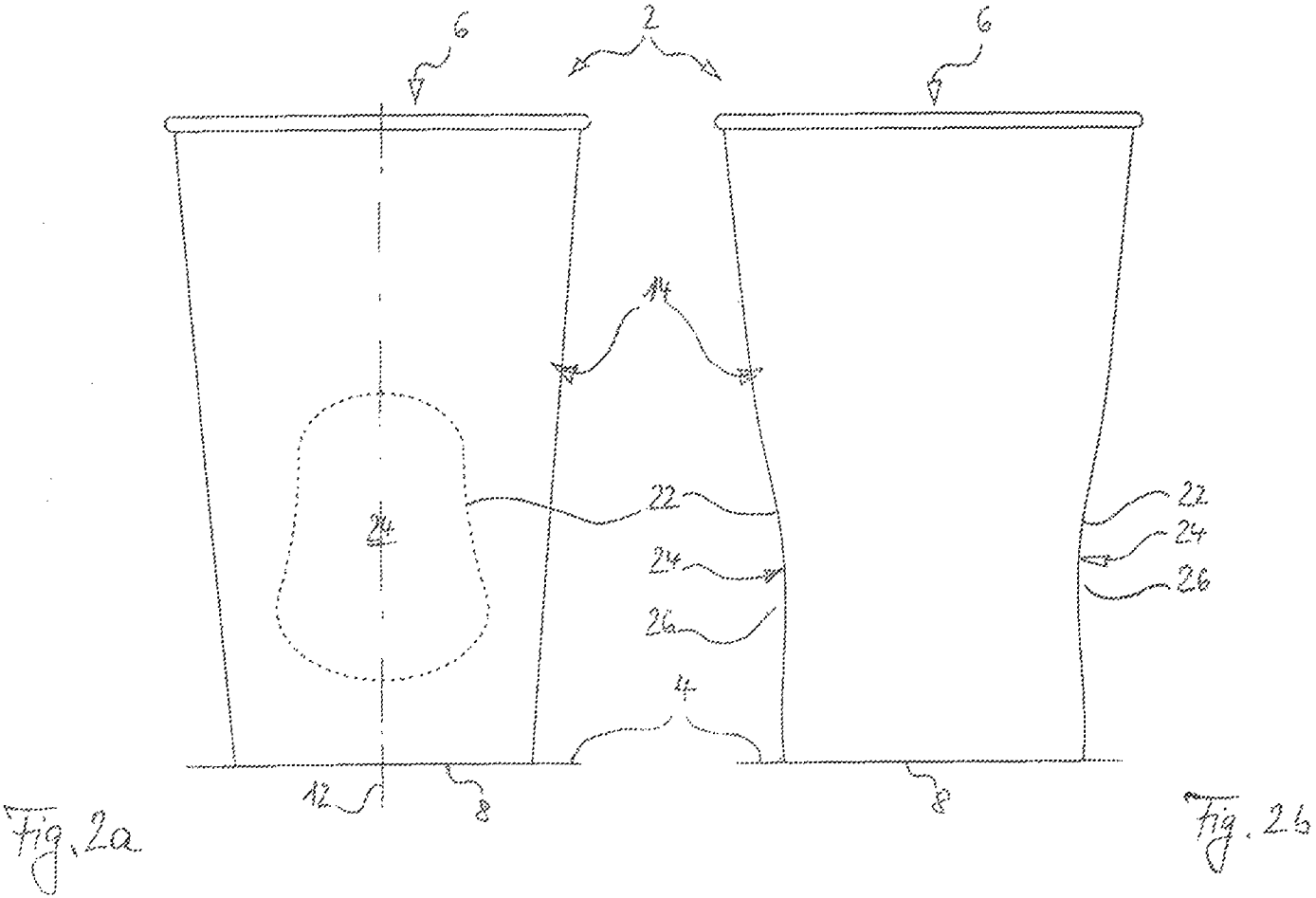
Figures 3A, 3B:
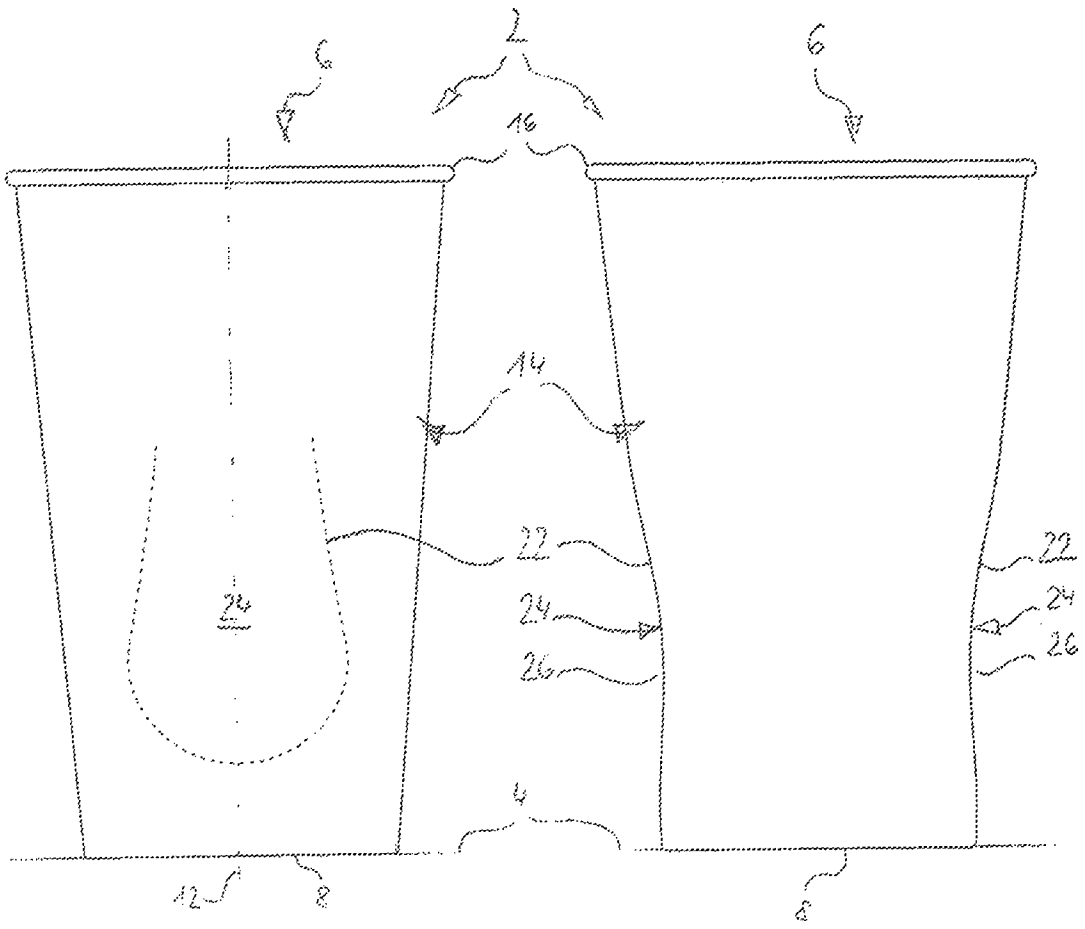
Figures 4A, 4B:
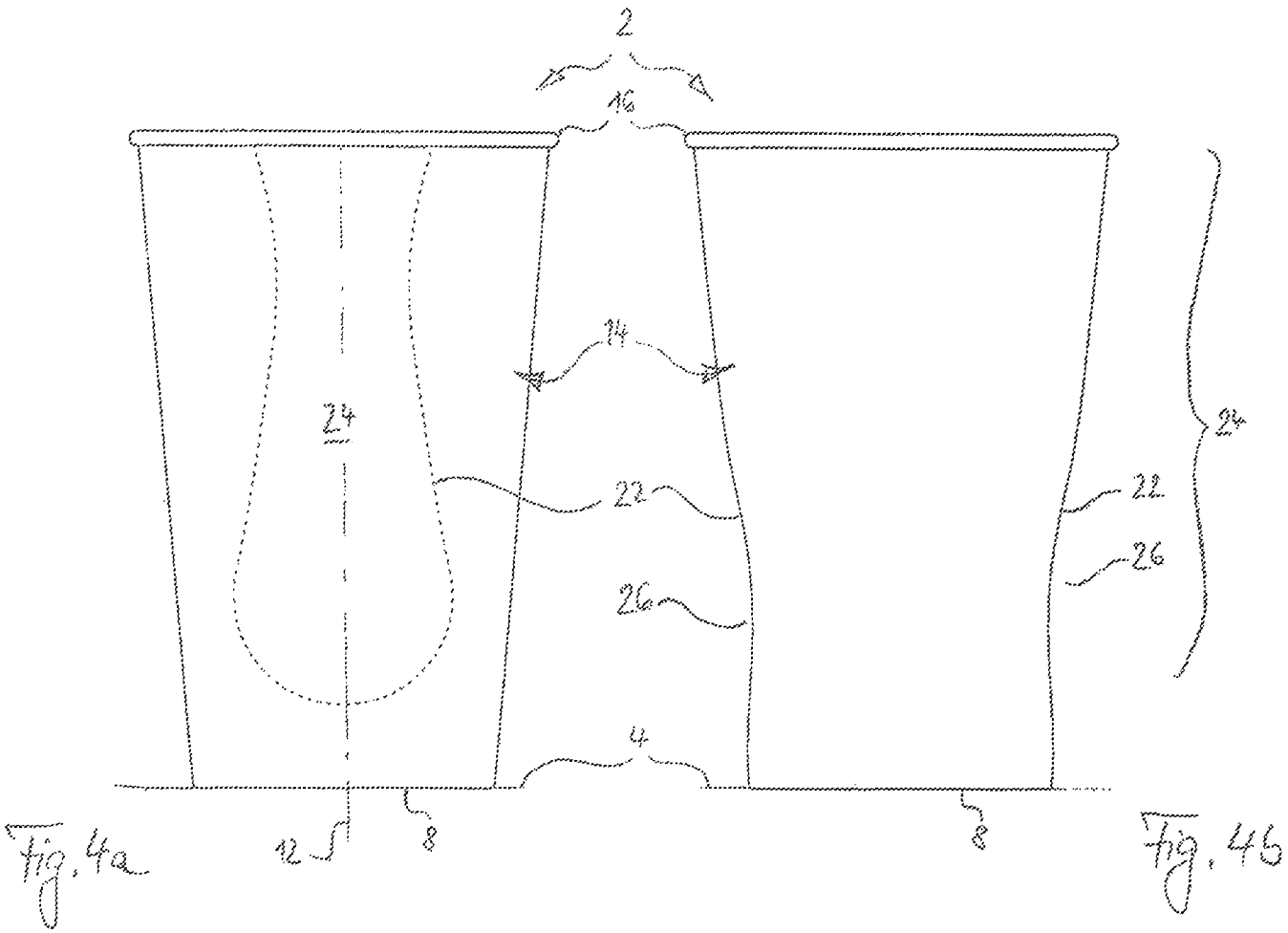
Figures 5A, 5B:
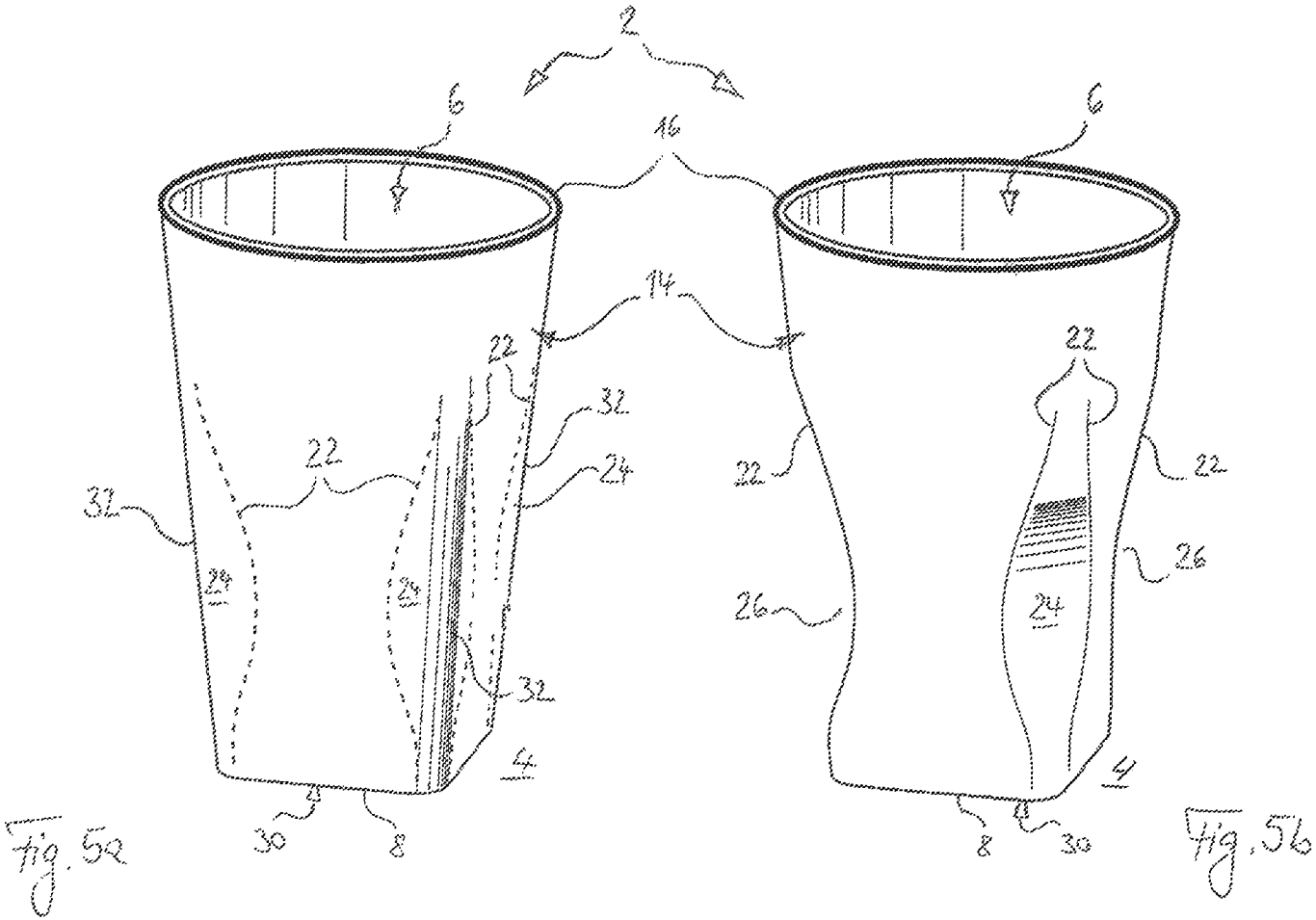
Figure 6B:
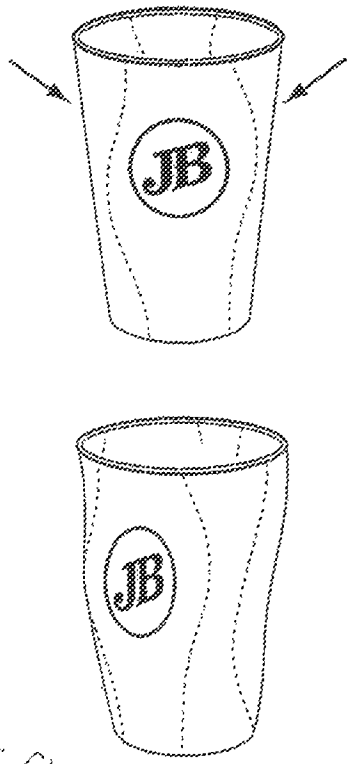
Figure 6A:
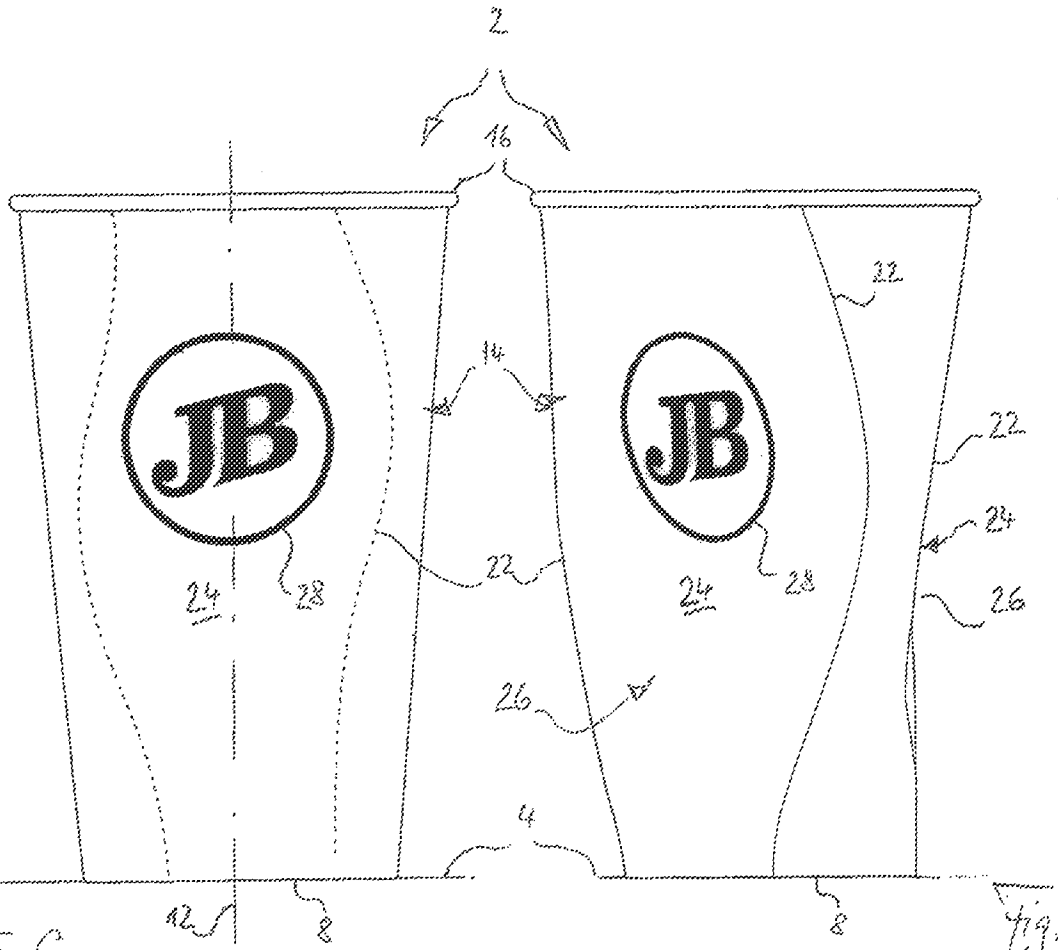

These and other advantages and features of the invention will be explained further with reference to the following figures of exemplary embodiments of the invention. In the figures:

FIGS. 1 *a* and *b* show a front view and side view of a cup according to the invention with pushed-in cup walls with a concave stable shape, FIGS. 2 *a* and *b* shown a front view and side view of an alternative cup according to the invention with pushed-in cup walls with a concave stable shape, FIGS. 3 *a* and *b* show a front view and side view of an alternative cup according to the invention with pushed-in cup walls with a concave stable shape, FIGS. 4 *a* and *b* show a front view and side view of an alternative cup according to the invention with pushed-in cup walls with a concave stable shape, FIGS. 5 *a* and *b* show equivalent three-dimensional views of an alternative cup with cup walls that can be pushed in with a concave stable shape, and then with cup walls that are pushed in with a concave stable shape, and FIGS. 6 *a* and *b* show two different three-dimensional side views of an alternative cup according to the invention with pushed-in cup walls with a concave stable shape.

A drinking cup 2 for hot or cold beverages to be discarded consisting of cardboard coated on the inside with plastic (properly set down on a horizontal plane 4) has, at the top, a drinking opening 6 and, at the bottom, an annular standing edge 8 that enables the cup 2 to be set down on a horizontal plane 4 so that the drinking liquid 10 remains in the cup. Overall, the cup 2 is rotationally symmetrical about a vertical axis 12, and its peripheral wall 14 narrows, not just in the area of the drinking opening 6 but rather overall, downward axially (in the direction of the vertical axis 12) in a conical shape from the edge of the drinking opening 6. The drinking opening 6 is surrounded by a drinking edge 16 which has a cross-section folded over in a circular manner to the outside.

To this extent, the cups 2 are designed the same in all the figures and are therefore provided with the same reference numbers for the same features despite their difference in terms of the different desired fold lines 22 according to the different figures.

Each of the cups 2 according to all of the figures has at least two desired fold lines 22 along which one or two convex walls 24 of the respective cup 2 can be pushed in in a concave stable shape. With the exception of FIG. 5*b*, the walls 24 of the respective cups 2 are all pushed in in a concave stable shape.

Each of the depicted desired fold lines 22 is a line 22 of a thinner wall thickness in the peripheral wall 14 of the respective cup, in this case namely a stamped line 22. If a user (not shown) pushes his thumb and/or index finger in close proximity to the desired fold line 22 of a cup wall 24 (initially convex to the outside before said impressing), the cup wall is deformed along the desired fold line 22 in a concave stable shape, i.e. pushed in a concave manner into the respective cup 2.

In FIGS. 1 and 2, each of the two desired fold lines in the cup wall 24 run in a closed ring—in FIGS. 3 and 4 symmetrically mirrored relative to the plane of the drawing as well as vertically in the plane of the drawing through the axis of symmetry 12 relative to the plane. Both are oriented vertically when the respective cup 2 stands properly and as depicted on the horizontal plane 4. Delimited by the ring-shaped (FIGS. 1 and 2) or U-shaped (FIGS. 3 and 4) desired fold line 22, a pushed-in area according to the invention results that is surrounded by the desired fold line 22 and, pushed in convexly, forms a recess 26 that can serve as a structural reinforcement of the peripheral wall 14, and that particularly preferably can also be used as a gripping recess. The U-shaped desired fold lines 22 according to FIGS. 3 and 4 run downward directly from the top (FIG. 4) or from below the edge (FIG. 3) of the drinking opening 6 and back to the edge of the drinking opening 6.

To aesthetically design the cup, the desired fold lines 22 that are curved as depicted are an additional design element that creates a waisted cup shaped in the lateral surface 14 after being pushed in where the respective recess 26 forms the waist.

Since the plurality of desired fold lines 22 in the cups 2 according to FIG. 1 to 5 are evenly distributed over a perimeter of the cup, and/or are arranged at the same height in the cup, a regular peripheral pattern of concave reinforcing impressions 26 results. If, as in FIG. 1 to 5, they lie opposite each other on the perimeter (distributed in pairs 180° on the perimeter), the waisted cup shape is especially well discernible. A waist 26 also results in a cup 2 according to FIG. 6. In this case, the desired fold lines run from the edge of the drinking opening 6 downward from the top of the cup 2 in a plurality of curves to the standing edge 8, wherein the curved lines surround and accentuate an emblem 28 in a curved manner. The curved lines can also be elements of a logo or emblem (such as a logo (not shown) of a well-known dark, nonalcoholic soft drink) that can, at least partially, also be imprinted.

The special feature of the cup 2 according to FIG. 5 in comparison to the other depicted cups is a total of eight desired fold lines 22 that run from the top clearly below the edge of the drinking opening 6 starting at the top of the cup 2 and running downward in a wave to the standing edge 8 (around a square base 30 with rounded corners) and distributed in pairs offset 180° over the perimeter, i.e., in pairs opposite each other over the perimeter and in pairs symmetrical to each other across two mirror planes standing vertically on the horizontal plane 10 that each run through diagonally opposite corners of the rectangular floor (30) (with rounded corners). These "corner edges" 32 (FIG. 6 *a*) can be pushed in, and are pushed in (as depicted in FIG. 6 *b*).

The invention claimed is:

1. A cup for drinking a liquid, the cup comprising:

an open top having a drinking edge extending around its periphery;

a standing edge at the bottom of the cup; and at least one convex cup wall comprising at least one predefined gripping recess defined by at least one desired fold line which runs as a closed curve, a U-shape, or as a pair of curved lines in the cup wall, wherein the gripping surface is structurally configured to move from an initial convex position to a stable concave position upon application of finger pressure, and the concave position provides structural reinforcement to the cup wall.

2. The cup according to claim 1, wherein the desired fold line in the cup wall is a line corresponding to a thinner wall thickness, a stamped line, and/or a prefolded line.

3. The cup according to claim 1, wherein the desired fold line in the cup wall runs symmetrically mirrored to a plane that is oriented vertically when the cup is standing properly on a horizontal plane.

4. The cup according to claim 1, comprising a plurality of equivalent desired fold lines.

5. The cup according to claim 1, comprising a plurality of desired fold lines which are evenly distributed over a perimeter of the cup.

6. The cup according to claim 1, comprising a plurality of desired fold lines which are arranged at the same height in the cup.

7. The cup according to claim 1, wherein the cup is rotationally symmetrical about a vertical axis.

* * * * *